US006425835B1

(12) United States Patent
Kettler

(10) Patent No.: US 6,425,835 B1
(45) Date of Patent: Jul. 30, 2002

(54) TABLE TENNIS TABLE

(75) Inventor: Heinz Kettler, Hauptstrasse 28, D-59469 Ense-Parsit (DE)

(73) Assignee: Heinz Kettler, Ense-Parsit (DE)

( * ) Notice: Subject to any disclaimer, the term of this patent is extended or adjusted under 35 U.S.C. 154(b) by 0 days.

(21) Appl. No.: 09/493,653

(22) Filed: Jan. 28, 2000

(30) Foreign Application Priority Data

Jan. 28, 1999 (DE) ..... 299 01 458 U

(51) Int. Cl.[7] ..... A63B 67/04; A63B 71/04

(52) U.S. Cl. ..... 473/496; 473/475; 108/167

(58) Field of Search ..... 473/490–496, 473/FOR 112–FOR 121; 108/167, 166, 106, 173, 171; D8/330, 331, 86; 292/202, 203, 218, 228; 403/321, 322.4, 322.2, 322.3, 322.1, 325; 188/67

(56) References Cited

U.S. PATENT DOCUMENTS 2,394,245 A * 2/1946 Koller ..... 108/167
2,913,294 A * 11/1959 Linde ..... 473/496
3,190,649 A * 6/1965 Heisler ..... 473/496
3,797,884 A * 3/1974 Gutierrez ..... 297/158.4
4,048,683 A * 9/1977 Chen ..... 5/180
4,424,912 A * 1/1984 Bieri et al. ..... 108/130
4,803,930 A * 2/1989 Crocoli ..... 108/117
5,417,513 A * 5/1995 Hayashi ..... 403/321
5,463,912 A * 11/1995 Inoue et al. ..... 403/321
5,678,948 A * 10/1997 White ..... 403/321
5,683,201 A * 11/1997 Guaron ..... 403/325
6,099,197 A * 8/2000 Gauron ..... 403/325

* cited by examiner

*Primary Examiner*—Paul T. Sewell
*Assistant Examiner*—Mitra Aryanpour
(74) *Attorney, Agent, or Firm*—Greenblum & Bernstein, P.L.C.

(57) ABSTRACT

Table tennis table including a frame, a pivot linkage, and two table halves which are secured to the frame by the pivot linkage to be pivotable between a substantially vertical storage position and a substantially horizontal play position. A releasable safety device is provided for each of the table halves that includes two safety levers each assuming an open position for changing the position of said table half. The table also includes at least one safety lever per table half having a locking device for holding purposes in the open position thereof.

22 Claims, 5 Drawing Sheets

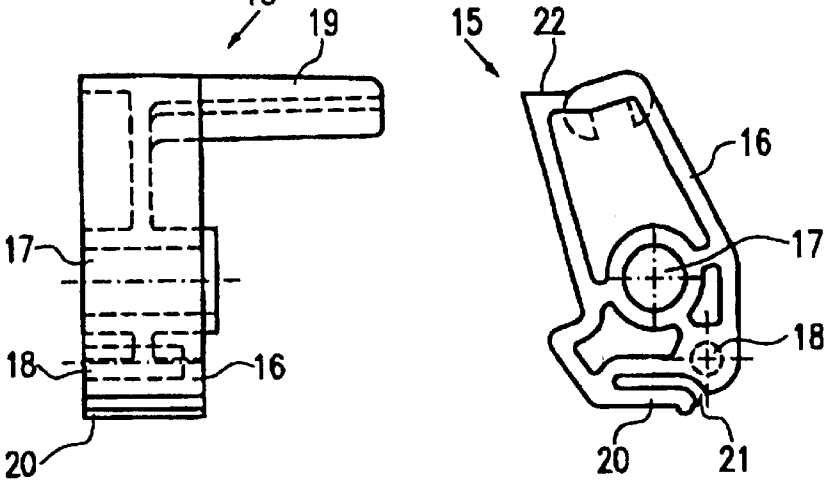
FIG.3c
FIG.3b
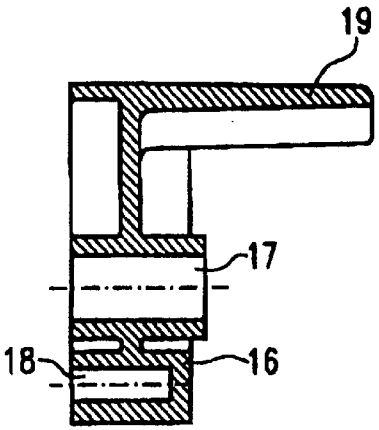
FIG.3e
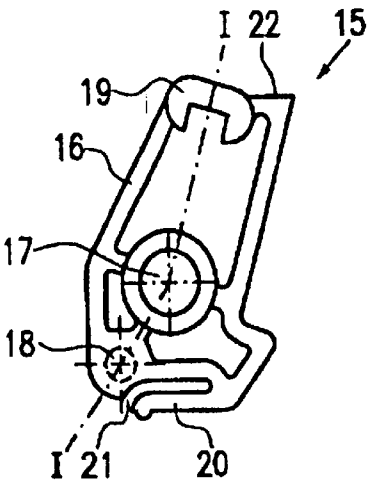
FIG.3a
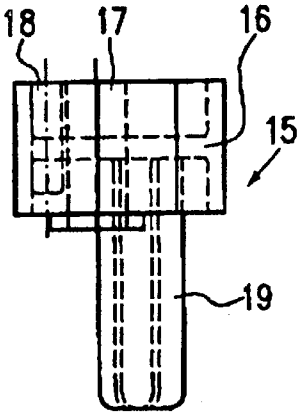
FIG.3d

TABLE TENNIS TABLE

CROSS-REFERENCE TO RELATED APPLICATIONS

The present application claims priority under 35 U.S.C. §119 of German Patent Application No. 299 01 458.4, filed on Jan. 28, 1999, the disclosure of which is expressly incorporated by reference herein in its entirety.

BACKGROUND OF THE INVENTION

1. Field of the Invention

The present invention relates to a table tennis table which includes a frame, a pivot linkage, two table halves that are secured to the frame by means of the pivot linkage to be pivotable between a substantially vertical storage position and a substantially horizontal play position, and a releasable safety device.

2. Discussion of Background Information

Such table tennis tables are equipped with pivotable table halves to occupy as little storage space as possible. The frame can be guided on wheels so that the table tennis table can be displaced easily. The two table halves can be pivoted between a play position and a storage position at an angle of about 90°. In the play position the two table halves form a horizontal even play surface which is divided in the middle by the net into two play halves. It is also possible to pivot only one table half into the play position so that a person can play with himself or herself against the second table half which is still in the storage position (playback operation).

In the case of such table tennis tables, there is the risk (above all in the case of an inexperienced operators, in particular by children) that in the play mode the table halves will collapse or will be collapsed unintentionally, which presents a serious risk of injury. In particular, there may be bruises or similar injuries caused by the tables moving towards each other.

Although various safety devices have been suggested for table tennis tables, these are primarily meant to prevent the table halves from pivoting from the storage position into the play position. Such safety means, however, do not offer an adequate protection against an unintended collapsing of the table halves from the play position into the storage position.

SUMMARY OF THE INVENTION

Therefore, the present invention provides a table tennis table which includes a safety device which is capable of preventing an unintended or undesired pivotable movement of the table halves.

In detail, the present invention relates to a table tennis table that includes a frame, a pivot linkage, two table halves and a releasable safety device. The two table halves are secured to the frame by a pivot linkage to be pivotable between a substantially vertical storage position and a substantially horizontal play position. The safety device is provided for each table half with two safety levers each assuming an open position for changing the position of the table half. Further, at least one at least one of the safety levers of each table half includes a locking device for holding the lever in its open position.

The safety device is designed such that it is also locked in the play mode. Hence, the table tennis table includes a total of at least two safety levers for each table half, i.e., at least four safety levers on the whole. The two safety levers of each table half are operative independently of each other and secure the table half put into the play position also individually. This means that the table half is already secured by one safety lever in the locking position. Thus the second safety lever has an additional safety function. Therefore, both of the existing safety levers must respectively be moved from the locking position into the open position for unlocking the safety device.

Since at least one safety lever includes a locking device for holding purposes in its open position, it is possible to actuate the lever at one side so that it is kept in the open position. Subsequently, the second lever must additionally be unlocked to move the table half, for instance, from the play position into the storage position. Since the locking device is provided on the first safety lever, it is possible to arrange the second safety lever at an adequate distance from the first safety lever. This means that the second safety lever can be arranged such that it cannot be operated by a person at the same time as the first safety lever. Nevertheless, thanks to the locking device provided on the first safety lever, the position of the table tennis table can be changed by only one person because the safety lever provided with the locking device remains in the open position after having been operated. To pivot the table half, the safety lever with the locking device lever must simply be unlocked in the first place and the person can then go to the second safety lever and unlock the same. The table half can thus not be pivoted when only one safety lever is unlocked. Hence, an unintended or undesired change in the position of the table halves can be prevented in an effective manner. Children, in particular, are also protected thereby because the function of the two safety levers which are in operative communication with each other and provided in each table half will remain unknown to them.

To reset the safety lever upon a change in position of the table half from the open position into a locking position, the table tennis table according to the invention includes a resetting device. The resetting device can e.g. be mounted on the bottom side of the table half so that upon each adjustment of the table side the safety levers are again moved into the locking position and the table half is thus secured again.

Preferably the safety lever is biased in the blocking or locking position so that the locking position is the basic position of the safety lever. It is thereby ensured that the safety lever without the locking device automatically assumes the locking position and the safety lever with the locking device resumes the locking position after release of the locking device. Preferably, the safety lever is biased by a spring element. Such a spring element may e.g. be a disk spring or a spiral spring.

To provide the two safety levers of a table half with an adequate distance from each other, the two safety levers for each table half are secured at opposite sides to the frame of the table tennis table. Hence, for releasing the safety device of one table half it is first the safety lever with the locking device that must be operated at one side of the table tennis table, the safety lever remaining in its open position because of the locking adjustment, and the table must then be walked round to reach the other side and to operate the second safety lever so that an adjustment of the table half is made possible. Hence, the two safety levers are spaced apart from each other to such an extent that they cannot be operated by one person at the same time.

Preferably, the safety levers for the one table half are each arranged in the vicinity of the safety levers of the other table half. This permits a compact construction of the safety means for the table tennis table.

Preferably, the neighboring safety levers of the two table halves are interconnected via a spring element. Thus one spring element is enough for biasing two safety levers each securing another table half. To produce a permanent bias, a safety lever without a locking device, i.e. a freely movable safety lever, is arranged in the vicinity of a safety lever equipped with a locking device.

Preferably, the locking device is designed as an elastic tongue. The locking device can thus be constructed on the safety lever in a simple manner and at low costs. To lock the safety lever in place, the tongue is guided over an edge so that the edge is positioned between the tongue and the safety lever. For unlocking purposes the elastic tongue is moved away from the edge some distance and is pressed towards the safety lever so that the gap existing between the elastic tongue and the safety lever is minimized and the tongue can be guided past the edge without getting hooked.

To permit an easy handling of the safety levers, the levers include a prolonged extension. For operating the safety lever the extension is just moved into the corresponding direction, whereby the safety lever changes its position. Preferably, the extended shoulder can also be guided through a slot provided in a cover, so that the safety lever is protected by the cover against damage and dirt.

To prevent a simultaneous operation of the safety levers of a table half, the safety levers are preferably only operable one after the other. To make the safety device as small as possible in size, the safety lever is biased against a guide rod of the pivot linkage. The guide rod is provided for guiding a slide shoe which in the play position is disposed at the upper end of the guide rod. In the storage position, the slide shoe is positioned at the lower end of the guide rod. While the table half is collapsed or unfolded, the slide shoe is guided on the guide rod from the one position into the respectively other position.

The present invention is directed to a table tennis table that includes a frame, a pivot linkage, and two table halves pivotably secured to the frame by the pivot linkage. Each of the table halves are pivotable between a substantially vertical storage position and a substantially horizontal play position. Releasable safety devices are provided for each of the table halves, and the releasable safety devices include two safety levers positionable into an open position to enable pivoting of a respective table half. At least one of the two safety levers for each of the table halves includes a locking device for holding the at least one safety lever in the open position.

According to a feature of the present invention, a resetting device can be arranged to reset the at least one safety lever from the open position to a locking position after the pivoting of the respective table half.

In accordance with another feature of the instant invention, the at least one safety lever for each of the table halves may be biased into a blocking position. Further, the at least one safety lever for each of the table halves can be biased by a spring.

According to still another feature of the invention, the two safety levers for each of the table halves may be secured to opposite sides of the frame.

The two safety levers for one of the table halves can each be arranged in a vicinity of the two safety levers for the other of the table halves. Further, the safety levers arranged in the vicinity of each other can be connected via a spring element. Still further, the safety levers of the one of the table halves can be coupled to the safety levers of the other of the table halves via a spring element. At least one of the two safety levers does not include a locking device, and the safety lever without a locking device can be arranged in the vicinity of the at least one safety lever with a locking device. The safety lever without the locking device and the safety lever with the locking device are arranged on different table halves.

According to a further feature of the instant invention, the locking device may include an elastic tongue on the safety lever.

In accordance with still another feature of the present invention, the safety levers may include an elongated extension to facilitate moving the safety levers into the open position.

In accordance with a still further feature of the invention, the safety levers are only operable in successive order.

Moreover, at least one slide shoe can be coupled to each. of the table halves, and a guide rod can be positioned to guide each of the slide shoes. The safety lever may be biased against one of the guide rods to prevent a respective slide shoe from sliding along the one guide rod.

The present invention is directed to a safety lever with a locking device for a table tennis table. The safety lever includes a base body, a support surface located at an upper end of the base body, an extension projecting laterally from the upper end of the base body, a circular portion coupled to the base body, such that the circular portion is adapted as a pivoting axis for the base body. A blind hole is formed in the base body below the circular portion, and a tongue extends from a lower end of the base body so as to form a slot between the tongue and the lower end of the base body.

The invention is directed to a releasable safety device for a table tennis table which is divided into pivotable two halves. The releasable safety device includes a first and second safety lever. The first safety lever includes a first base body, a first support surface located at an upper end of the first base body, a first extension projecting laterally from the upper end of the first base body, and a first circular portion coupled to the first base body, so that the first circular portion is adapted as a pivoting axis for the first base body. A first blind hole is formed in the first base body below the first circular portion, and a tongue extends from a lower end of the first base body so as to form a slot between the tongue and the lower end of the first base body. The second safety lever includes a second base body, a second support surface located at an upper end of the second base body, a second extension projecting laterally from the upper end of the second base body, and a second circular portion coupled to the first base body, such that the second circular portion is adapted as a pivoting axis for the second base body. A second blind hole is formed in the second base body below the second circular portion.

In accordance with a feature of the present invention, the first and the second circular portions can be collinearly arranged to pivot around a same pivot axis, and the first and the second safety levers can be positionable on a same half of the table tennis table.

According to another feature of the invention, the pivot axes for first and second circular portions can be parallel to each other, and the first and the second safety levers may be positionable on different halves of the table tennis table. Further, the first and the second blind holes can be coupled to each other via a spring element.

In accordance with yet another feature of the invention, the second safety lever does not include a tongue that extends from a lower end of the base body so as to form a slot between the tongue and the lower end of the base body.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 3*a* is a lateral view from the right side of a safety lever comprising a locking device;

FIG. 3*b* is a front view of the safety lever of FIG. 3*a;*

FIG. 3*c* is a lateral view from the left side of the safety lever of FIG. 3*a;*

FIG. 3*d* is a top view on the safety lever of FIG. 3*a;*

FIG. 3*e* is a sectional view along line I—I of FIG. 3*a;*

DETAILED DESCRIPTION OF THE PRESENT INVENTION

The particulars shown herein are by way of example and for purposes of illustrative discussion of the embodiments of the present invention only and are presented in order to provide what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
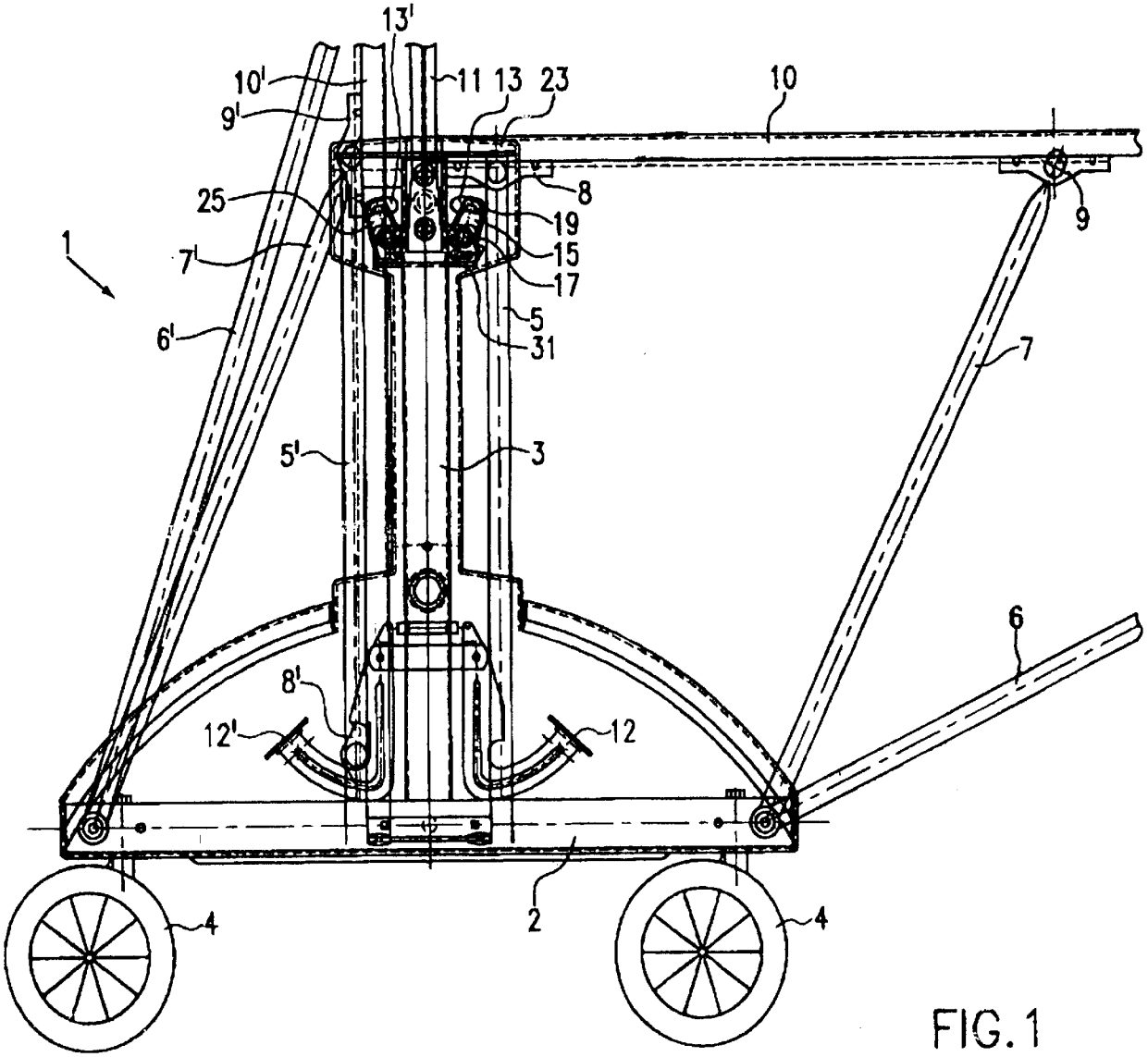
FIG. 1 is a partial lateral view of a table tennis table according to an embodiment of the present invention.

FIG. 1 shows an embodiment of a table tennis table according to the invention. The table tennis table includes a frame which is formed of a plurality of interconnected square tubes 2, 3. The square tube 3 is here arranged in the customary manner in a direction perpendicular to the square tube 2. Furthermore, at each side of the table tennis table 1 two respective wheels 4 are secured to the square tube 2 e.g., via screws.

Furthermore, the table tennis table 1 includes two table halves 10, 10'. Since the table tennis table is of a symmetrical construction, the structural members of the second table half 10' which are identical with those of the first table half 10 shall be designated in the following text by the same reference numeral and by a ' (i.e., prime). The table halves 10, 10' are connected to the frame 2, 3 of the table tennis table 1 via a pivot linkage. The pivot linkage includes a guide rod 5, 5', pivot rods 6, 6', 7, 7' and articulated shoes 8, 8', 9, 9' (cf. FIG. 1).

Figure 2:
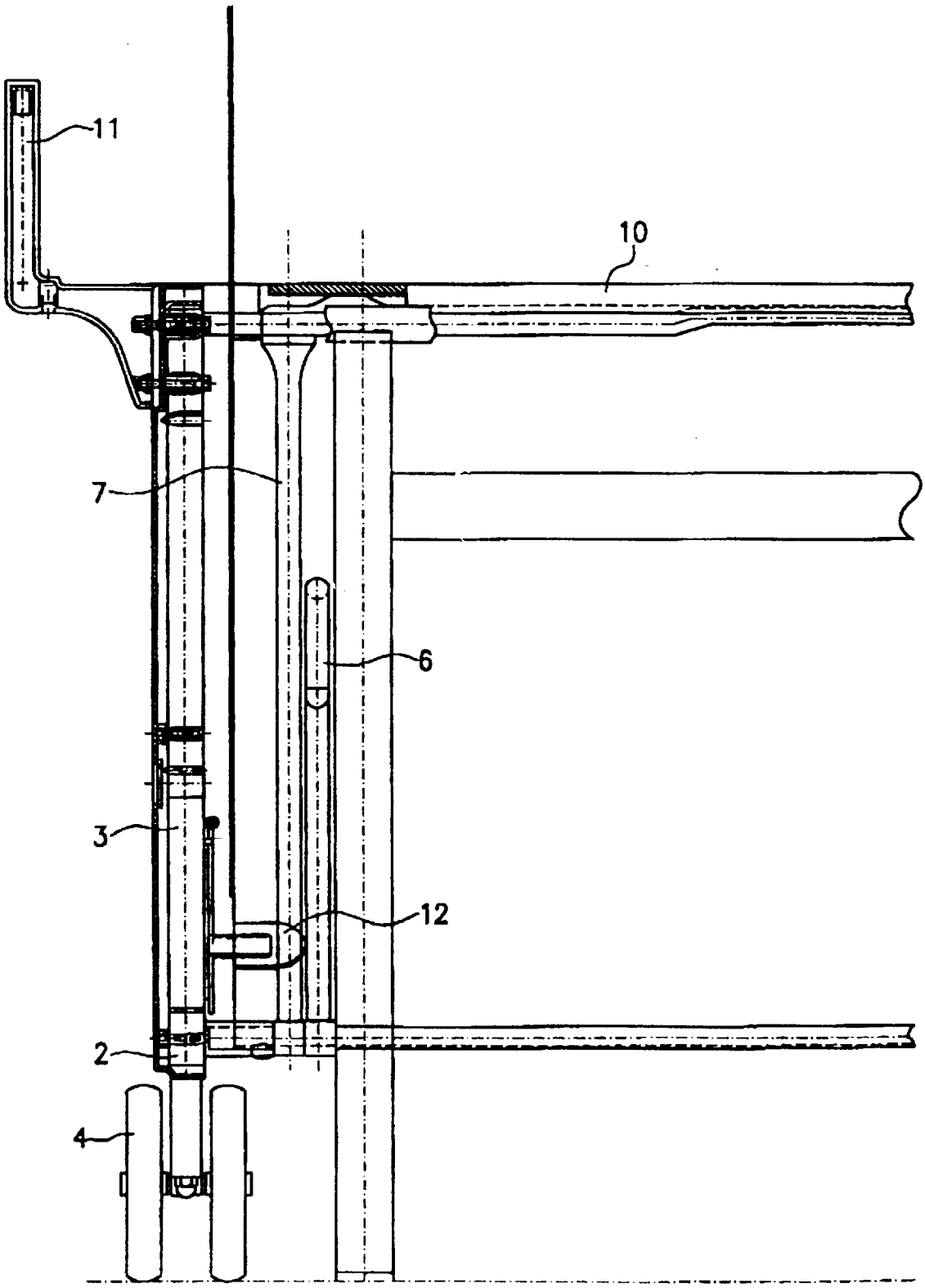
FIG. 2 is a partial view from the right side of the embodiment shown in FIG. 1.
Figure 4C:
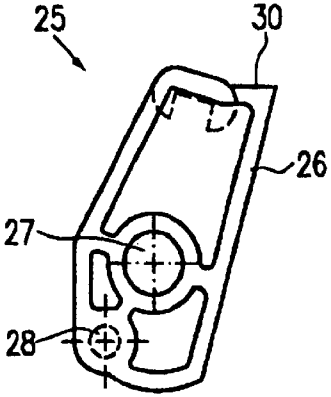
FIG. 4*c* is a lateral view from the left side of the safety lever shown in FIG. 4*a;*
Figure 4B:
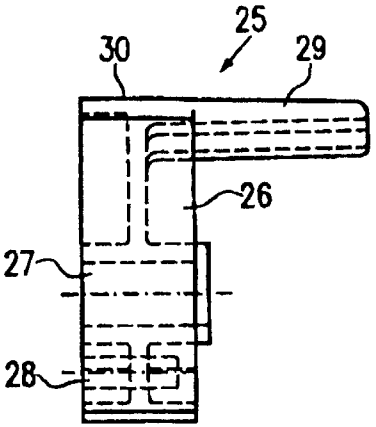
FIG. 4*b* is a front view of the safety lever shown in FIG. 4*a;*
Figure 4E:
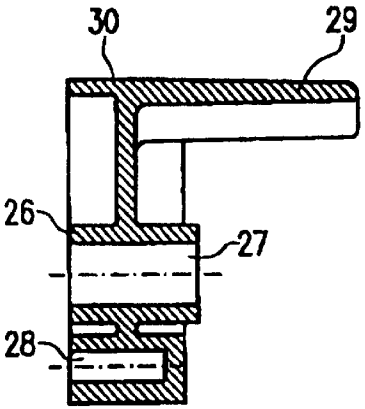
FIG. 4*e* is a sectional view taken along line II—II of FIG. 4*a;*
Figure 4A:
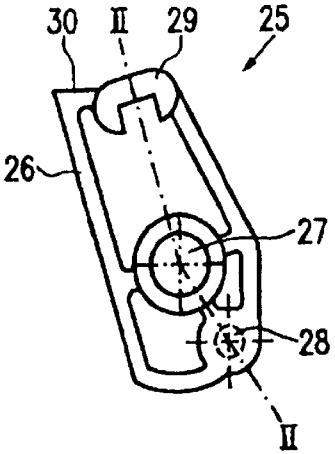
FIG. 4*a* is a lateral view from the right side of a safety lever without a resetting device.
Figure 4D:
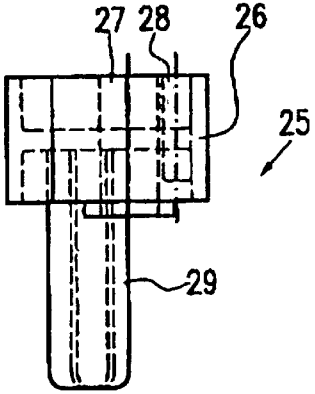
FIG. 4*d* is a top view on the safety lever shown in FIG. 4*a;*

Furthermore, the table tennis table according to the invention includes a releasable safety device 15, 25. The safety device includes two safety levers which for better illustration are shown in FIGS. 3*a* to 3*e* and 4*a* to 4*e* and shall be described in more detail below. As shown in FIG. 1, the safety levers 15, 25 are secured to the square rod 3 of the frame via an L-shaped knee 31. Furthermore, a mounting 11 for a net is provided on rod 3. Since the table tennis table is of a symmetrical construction, the side of the table tennis table that is not shown is designed in the same manner as the side shown in FIGS. 1 and 2.

FIGS. 3*a* to 3*e* are detail views showing the safety lever together with a locking device. The safety lever 15 includes a base body 16 and is preferably made from a plastic material. A passage opening 17 and a blind hole or non-continuous opening 18 are provided in the basic body 16. Furthermore, an extension or elongated portion 19 is arranged on the upper part of the basic body 16 to permit an easier handling of the safety lever 15. In the lower portion of the safety lever 15 an elastic tongue 20 is provided as the locking device. As shown in FIGS. 3*a* and 3*c,* the elastic tongue 20 slightly projects from the basic body 16 of the safety lever 15. A small slot 21 is thereby created between the elastic tongue 20 and the basic body 16, which after the safety lever has been rotated about the central axis of the passage opening 17, the central axis serves as an axis of rotation, permits a locking in place at an edge of the L-shaped knee 31. However, it is also possible to provide a special projection, or the like, for the locking operation.

As becomes further apparent from the sectional view shown in FIG. 3*e,* the safety lever 15 may be produced as an easily producible plastic member of a correspondingly low weight, but of adequate strength. Starting from the passage opening 17, the upper part of the basic body 16 is slightly inclined (cf. FIGS. 3*a* and 3*c*). Furthermore, a support surface 22 is provided at the upper end of the basic body 16. The safety lever is secured to the table tennis table 1 to be rotatable about the central axis of the passage opening 17.

FIGS. 4*a* to 4*e* show a second safety lever 25. The safety lever 25 does not comprise a locking device. Otherwise, it is made similar to the safety lever 15. The safety lever 25 comprises a basic body 26, a passage opening 27, a blind hole 28 and an elongated extension 29. Furthermore, a support surface 30 is arranged on the upper end of the basic body 26. In the mounted state the safety lever 25 is supported to be rotatable about the central axis of the passage opening 27.

Figure 5:
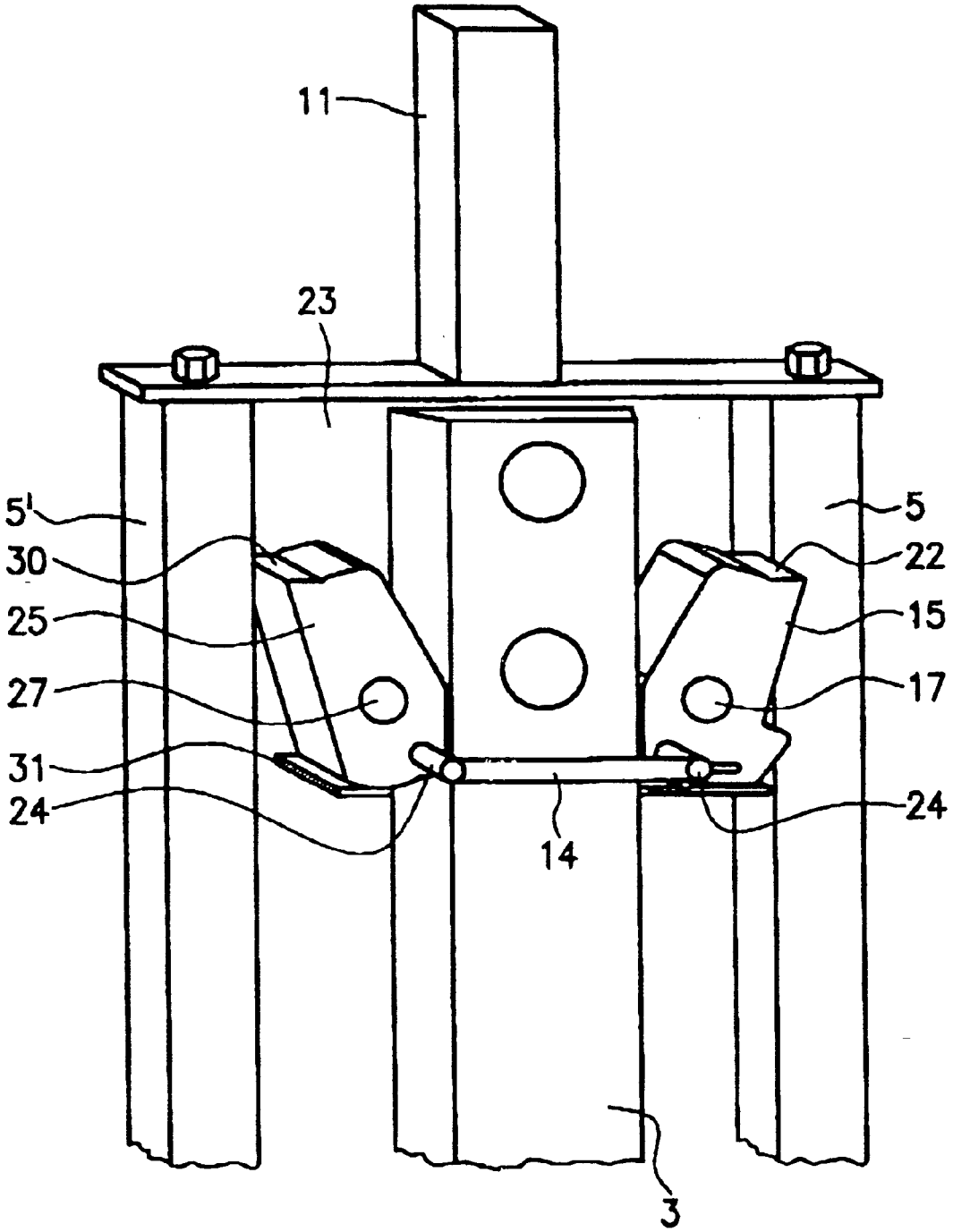
FIG. 5 is a perspective view of safety levers mounted on the table tennis table.

As shown in FIG. 5, the two safety levers 15, 25 are secured in the mounted state to the square tube 3 by the L-shaped knee 31 to be rotatable about the central axes of the passage holes 17 and 27, respectively. Furthermore, a pin 24 which is provided with a groove is introduced into each of the blind holes 18 and 28, respectively. The two safety levers 15, 25 are connected to each other via the pins 24 and a spring 14 (cf. FIG. 5). Corresponding safety levers 15, 25 are provided at the other side of the table tennis table in the same way as shown in FIG. 5, so that a total of four safety levers are provided on the table tennis table. The respective safety levers, however, are arranged at the two sides of the table tennis table in such fashion that one respective safety lever 15 with a locking device and one respective safety lever 25 without a locking device are assigned to a table half 10 and 10', respectively. This means that each table half includes one safety lever with a locking device and one safety lever without a locking device.

As shown in FIG. 5, the support surfaces 22 and 30 of the respective safety levers directly rest on the guide rods 5 and 5', respectively, of the pivot linkage (cf. also FIG. 1). When the table halves are unfolded or swung outwards, the slide shoe 8 and 8', respectively, can thus not be guided along the guide rod 5 and 5', respectively, as said passage is blocked by the safety lever 15 and 25, respectively. In the illustrated embodiment the table half 10 can be moved for a short distance towards the storage position, but will then be blocked by the safety lever 15. However, it is also possible to mount the safety levers in such a manner that a displacement of the table halves is not at all possible.

When the safety lever 15 is now moved by the elongated extension 19, which projects through an arcuate slot 13 out of a cover 23 (cf. FIG. 1), from the position shown in FIG. 1 to the left side into the open position, the elastic tongue 20 of the safety lever 15 will lock in place at an edge. As a result, the safety lever 15 will maintain its open position. Subsequently, the safety lever without the locking device, which is arranged at the other side of the table tennis table (not shown), must be operated for folding the table half 10 upwards, and it must be held while the table half 10 is folded upwards until the articulated shoe 8 locks into the holding device 12 via the running surface of the holding device 12. As a result, the table half 10 in the storage position is now fixedly secured in the holding device 12. While the articulated shoe 8 is sliding downwards along the guide rod 5, the safety lever 15 is again returned into the initial position, i.e. into the locking position, as soon as the articulated shoe 8 has passed the safety lever 15. However, it is also possible that the safety lever 15 will only be pressed into its locking position when the table half 10 is put into the upright position.

Hence, the design of the safety device according to the invention ensures that at least two safety levers have to be operated for pivoting one table half, which safety levers cannot be operated by one person at the same time. Nevertheless, the table tennis table 1 can only be collapsed by one person because one safety lever 15 is equipped with a locking device and the other safety lever 25 must be kept pressed when the table is put into an upright position, whereby the lever is also moved out of its locking position during the collapsing operation. Furthermore, it is ensured that the respective safety levers which comprise the locking device will again be pressed into the locking position at the latest after one table half has been folded downwards, so that an unintended or undesired collapsing of the table tennis table is prevented.

It should be noted that the safety device according to the invention can also be used in other devices or folding mechanisms which are similar to the one of the table tennis table 1 described according to the invention.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A table tennis table comprising:

a frame;

a pivot linkage;

two table halves pivotably secured to said frame by said pivot linkage, wherein each of said table halves are pivotable between a substantially vertical storage position and a substantially horizontal play position;

releasable safety devices being arranged such that a separate releasable safety device is coupled to each respective table half, and each said releasable safety device includes two safety levers positionable into an open position to enable pivoting of a respective table half; and at least one of said two safety levers for each said releasable safety device includes a locking device for holding said at least one safety lever in the open position.

2. The table tennis table in accordance with claim 1, further comprising a resetting device arranged to reset said at least one safety lever from the open position to a locking position after the pivoting of said respective table half.

3. The table tennis table in accordance with claim 1, wherein said at least one safety lever for each of said table halves is biased into a blocking position.

4. The table tennis table in accordance with claim 3, wherein said at least one safety lever for each of said table halves is biased by a spring.

5. The table tennis table in accordance with claim 1, wherein said two safety levers for each of said table halves are secured to opposite sides of said frame.

6. The table tennis table in accordance with claim 1, wherein said two safety levers for one of said table halves are each arranged in a vicinity of said two safety levers for the other of said table halves.

7. The table tennis table in accordance with claim 6, wherein said safety levers arranged in the vicinity of each other are connected via a spring element.

8. The table tennis table in accordance with claim 6, wherein said safety levers of said one of said table halves are coupled to said safety levers of said other of said table halves via a spring element.

9. The table tennis table in accordance with claim 6, wherein at least one of said two safety levers does not include a locking device, and said safety lever without a locking device is arranged in the vicinity of said at least one safety lever with a locking device.

10. The table tennis table in accordance with claim 9, wherein said safety lever without a locking device and said safety lever with a locking device are arranged on different table halves.

11. The table tennis table in accordance with claim 1, wherein said locking device comprises an elastic tongue on said safety lever.

12. The table tennis table in accordance with claim 1, wherein said safety levers comprise an elongated extension to facilitate moving said safety levers into said open position.

13. The table tennis table in accordance with claim 1, wherein said safety levers are only operable in successive order.

14. A table tennis table comprising:

a frame;

a pivot linkage;

two table halves pivotably secured to said frame by said pivot linkage, wherein each of said table halves are pivotable between a substantially vertical storage position and a substantially horizontal play position;

releasable safety devices being arranged such that a releasable safety device is coupled to each respective table half, and each said releasable safety device coupled to a respective table half includes two safety levers positionable into an open position to enable pivoting of a respective table half;

at least one of said two safety levers for each said releasable safety device comprising a locking device for holding said at least one safety lever in the open position; and at least one slide shoe coupled to each of said table halves, and a guide rod positioned to guide each of said slide shoes, wherein said safety lever is biased against one of said guide rods to prevent a respective slide shoe from sliding along said one guide rod.

15. A table tennis table comprising:

a frame;

a pivot linkage;

two table halves pivotably secured to said frame by said pivot linkage, wherein each of said table halves are pivotable between a substantially vertical storage position and a substantially horizontal play position;

releasable safety devices for each of said table halves, said releasable safety devices comprising two safety levers positionable into an open position to enable pivoting of a respective table half; and at least one of said two safety levers for each of said table halves comprising a locking device for holding said at least one safety lever in the open position, wherein at least one of said safety levers comprises:

a base body;

a support surface located at an upper end of said base body;

an extension projecting laterally from said upper end of said base body;

a circular portion coupled to said base body, said circular portion adapted as a pivoting axis for said base body;

a blind hole formed in said base body below said circular portion; and a tongue extending from a lower end of said base body so as to form a slot between said tongue and said lower end of said base body.

16. A table tennis table comprising:

a frame;

a pivot linkage;

two table halves pivotably secured to said frame by said pivot linkage, wherein each of said table halves are pivotable between a substantially vertical storage position and a substantially horizontal play position;

releasable safety devices for each of said table halves, said releasable safety devices comprising two safety levers positionable into an open position to enable pivoting of a respective table half; and at least one of said two safety levers for each of said table halves comprising a locking device for holding said at least one safety lever in the open position, wherein said two safety levers of said releasable safety devices comprise:

a first safety lever comprising:

a first base body;

a first support surface located at an upper end of said first base body;

a first extension projecting laterally from said upper end of said first base body;

a first circular portion coupled to said first base body, said first circular portion adapted as a pivoting axis for said first base body;

a first blind hole formed in said first base body below said first circular portion; and a tongue extending from a lower end of said first base body so as to form a slot between said tongue and said lower end of said first base body; and a second safety lever comprising:

a second base body;

a second support surface located at an upper end of said second base body;

a second extension projecting laterally from said upper end of said second base body;

a second circular portion coupled to said first base body, said second circular portion adapted as a pivoting axis for said second base body; and a second blind hole formed in said second base body below said second circular portion.

17. The safety device in accordance with claim 16, wherein said first and said second circular portions are collinearly arranged to pivot around a same pivot axis, and wherein said first and said second safety levers are positionable on a same half of the table tennis table.

18. The safety device in accordance with claim 16, wherein said pivot axes for first and second circular portions are parallel to each other, and wherein said first and said second safety levers are positionable on different halves of the table tennis table.

19. The safety device in accordance with claim 18, wherein said first and said second blind holes are coupled to each other via a spring element.

20. The safety device in accordance with claim 16, wherein said second safety lever does not include a tongue extending from a lower end of said second base body so as to form a slot between the tongue and said lower end of said second base body.

21. The table tennis table in accordance with claim 1, wherein said two safety levers for each said releasable safety device are arranged on oppose sides of said respective table halves.

22. The table tennis table in accordance with claim 1, wherein said safety levers comprising said locking devices are positioned on opposite sides of said table.

* * * * *